US012799691B2

(12) United States Patent
Wang et al.

(10) Patent No.: US 12,799,691 B2
(45) Date of Patent: Nov. 17, 2026

(54) STAY CABLE LEVER MASS DAMPER

(71) Applicants: CHINA RAILWAY BRIDGE RESEARCH TECHNOLOGY CO., LTD, Wuhan (CN); CHINA RAILWAY MAJOR BRIDGE ENGINEERING GROUP CO., LTD, Wuhan (CN)

(72) Inventors: Zhengxing Wang, Wuhan (CN); Bo Wang, Wuhan (CN); Xiaopeng Chai, Wuhan (CN); Nengjun Sheng, Wuhan (CN); Haiwei Zhao, Wuhan (CN); Pengfei Liu, Wuhan (CN); Dongchao Li, Wuhan (CN); Rucheng Wang, Wuhan (CN); Yamin Li, Wuhan (CN); Zhao Jin, Wuhan (CN); Jiang Lv, Wuhan (CN); Sai Chen, Wuhan (CN); Zhida Zhao, Wuhan (CN)

(73) Assignees: CHINA RAILWAY BRIDGE RESEARCH TECHNOLOGY CO., LTD;, Wuhan (CN); CHINA RAILWAY MAJOR BRIDGE ENGINEERING GROUP CO., LTD, Wuhan (CN)

( * ) Notice: Subject to any disclaimer, the term of this patent is extended or adjusted under 35 U.S.C. 154(b) by 5 days.

(21) Appl. No.: 19/026,486

(22) Filed: Jan. 17, 2025

(65) Prior Publication Data

US 2025/0237022 A1 Jul. 24, 2025

Related U.S. Application Data

(63) Continuation of application No. PCT/CN2024/107423, filed on Jul. 25, 2024.

(30) Foreign Application Priority Data

Jan. 19, 2024 (CN) ..... 202410083175.7

(51) Int. Cl.
*E01D 19/16* (2006.01)
*E01D 11/04* (2006.01)

(52) U.S. Cl.
CPC ..... *E01D 19/16* (2013.01); *E01D 11/04* (2013.01)

(58) Field of Classification Search
CPC ..... E01D 11/04; E01D 19/16; E01D 19/14
USPC ..... 248/636, 564; 14/22
See application file for complete search history.

(56) References Cited

U.S. PATENT DOCUMENTS

2002/0104175 A1* 8/2002 Zivanovic ..... E01D 19/16 14/22
2016/0319499 A1* 11/2016 Annan ..... F16F 9/18

FOREIGN PATENT DOCUMENTS

| | | | | |
|---|---|---|---|---|
| CN | 103526692 A | | 1/2014 | |
| CN | 102561184 B | * | 10/2014 | |
| CN | 109235229 A | * | 1/2019 | ..... E01D 19/042 |
| CN | 109371837 A | * | 2/2019 | ..... G01L 5/00 |
| CN | 110158465 A | | 8/2019 | |
| CN | 213061703 U | | 4/2021 | |
| CN | 217869987 U | * | 11/2022 | |
| CN | 117702604 A | | 3/2024 | |
| KR | 100770433 B1 | | 10/2007 | |

* cited by examiner

*Primary Examiner* — Christopher Garft
(74) *Attorney, Agent, or Firm* — Bayramoglu Law Offices LLC

(57) ABSTRACT

A stay cable lever mass damper is provided. The stay cable lever mass damper includes a support, a connecting piece, a main lever, a first damping device and a second damping device. The connecting piece is configured to connect with a stay cable; one end of the main lever is fixedly connected to the connecting piece, and the other end is rotatably connected to the support; the first damping device is connected to an upper end of the main lever and configured to mitigate in-plane vibration on the main lever; and the second damping device is connected to a lower end of the main lever and configured to mitigate out-of-plane vibration on the main lever. The vibration of the stay cable is transferred to the connecting piece through connecting the stay cable to the connecting piece.

9 Claims, 2 Drawing Sheets

STAY CABLE LEVER MASS DAMPER

CROSS-REFERENCE TO THE RELATED APPLICATIONS

This application is a continuation application of International Application No. PCT/CN2024/107423, filed on Jul. 25, 2024, which is based upon and claims priority to Chinese Patent Application No. 202410083175.7, filed on Jan. 19, 2024, the entire contents of which are incorporated herein by reference.

TECHNICAL FIELD

The present invention relates to the technical field of bridge vibration control, and in particular to a stay cable lever mass damper.

BACKGROUND

As our infrastructure level continues to improve, the construction technology of large-span cable-stayed bridges is becoming increasingly sophisticated. As the main load-bearing component of the cable-stayed bridge, the stay cable has the characteristics of high flexibility and low damping. Due to these characteristics, the stay cable of large-span cable-stayed bridge is prone to experiencing large-amplitude vibrations in high-wind environments. Prolonged large-amplitude vibrations of the stay cable can easily cause fatigue damage to the cable and associated structures, severely impacting the service life of the stay cable. At the same time, it can also create a sense of insecurity for pedestrians and vehicles on the cable-stayed bridge.

In the prior art, a damper is often provided at a certain height at the cable end to suppress the vibration of the stay cable through increasing the additional damping.

In the prior art, for super-long stay cables or stay cables with anchor plates, in order to ensure that the installation position meets basic requirements, the installation height of the damper generally needs to be quite large. If a conventional external damper is used, a large-volume bracket is required to ensure the supporting stiffness of the damping device, resulting in excessive investment in the bracket and waste of materials.

Moreover, existing damper designs are primarily focused on in-plane vibrations of the stay cables. In actual bridge conditions, the stay cables may also experience out-of-plane vibrations due to the perpendicular direction of the cable vibrations relative to the wind direction. When the external wind load is roughly parallel to the bridge axis, the stay cables may undergo significant out-of-plane vibrations. The existing lever mass damping vibration reduction technology is primarily designed to address in-plane vibrations and is insufficient in controlling out-of-plane vibrations of the stay cables.

Therefore, it is very necessary to provide a cable stay lever damper to solve the above-mentioned technical problems.

SUMMARY

The embodiment of the present invention provides a stay cable lever mass damper, which can solve the problem that the existing lever mass damping vibration reduction technology in the related art is primarily designed to address in-plane vibrations and is insufficient in controlling out-of-plane vibrations of the stay cables.

On the one hand, the embodiment of the present invention provides a stay cable lever mass damper, comprising:

- a support;
- a connecting piece, which is configured to connect with a stay cable;
- a main lever, one end of which is fixedly connected to the connecting piece, and the other end is rotatably connected to the support;
- a first damping device, which is connected to an upper end of the main lever and configured to mitigate in-plane vibration on the main lever; and
- a second damping device, which is connected to a lower end of the main lever and configured to mitigate out-of-plane vibration on the main lever.

Further, a first ear plate and a second ear plate are provided on the support;

the first damping device comprises:

- an in-plane damper, which is rotatably connected to the second ear plate; and
- an in-plane lever, a middle part of which is rotatably connected to the main lever, one end of the in-plane lever is rotatably connected to the first ear plate, and the other end is connected to the in-plane damper.

Further, the stay cable lever mass damper further comprises: a first deep groove ball bearing and a second deep groove ball bearing, wherein the in-plane lever is rotatably connected to the first ear plate through the first deep groove ball bearing; and the middle part of the in-plane lever is rotatably connected to the main lever through the second deep groove ball bearing.

Further, the stay cable lever mass damper further comprises: a first joint bearing and a second joint bearing, the in-plane lever is rotatably connected to the in-plane damper through the first joint bearing, and the in-plane damper is rotatably connected to the second ear plate through the second joint bearing.

Further, a third ear plate is provided on the support;

the second damping device comprises:

- an out-of-plane damper, which is rotatably connected to a middle part of the main lever;
- an out-of-plane link rod, one end of which is rotatably connected to a bottom part of the main lever; and
- an out-of-plane lever, one end of which is rotatably connected to the out-of-plane link rod, the other end of the out-of-plane lever is rotatably connected to the out-of-plane damper, and the middle part of the out-of-plane lever is rotatably connected to the third ear plate.

Further, the stay cable lever mass damper further comprises: a third deep groove ball bearing, a fourth deep groove ball bearing and a fifth deep groove ball bearing, wherein the out-of-plane link rod is rotatably connected to the main lever through the third deep groove ball bearing; the out-of-plane link rod is rotatably connected to the out-of-plane lever through the fourth deep groove ball bearing; and the out-of-plane lever is rotatably connected to the third ear plate through the fifth deep groove ball bearing.

Further, the stay cable lever mass damper further comprises: a third joint bearing and a fourth joint bearing, wherein the out-of-plane lever is rotatably connected to the out-of-plane damper through the third joint bearing; and the out-of-plane damper is rotatably connected to the main lever through the fourth joint bearing.

Further, the connecting piece comprises:

- a cable clamp, which is configured to connect with the stay cable;

a connecting rod, which is rotatably connected to the main lever; and a fifth joint bearing, through which the cable clamp is rotatably connected to the connecting rod.

Further, an outer frame is sleeved on the support.

Further, an embedded plate is connected to a bottom part of the support.

The beneficial effects brought about by the technical solution provided by the present invention comprise:

the vibration of the stay cable is transferred to the connecting piece through connecting the stay cable to the connecting piece, the vibration is transmitted to the main lever through connecting the main lever to the connecting piece, and the first damping device is connected to the upper end of the main lever and configured to mitigate the in-plane vibration on the main lever; and the second damping device is connected to the lower end of the main lever and configured to mitigate the out-of-plane vibration on the main lever.

BRIEF DESCRIPTION OF THE DRAWINGS

In order to better illustrate the technical solution in the embodiments of the present application, the following will briefly introduce the drawings needed in the description of the embodiments, and it is obvious that the drawings in the following description are only a part of embodiments of the present application, for those of ordinary skill in the art, other drawings may also be obtained based on these drawings without any inventive effort.

In the figures: 1—support; 2—connecting piece; 3—main lever; 4—the first damping device; 5—the second damping device; 6—the first ear plate; 7—the second ear plate; 8—in-plane damper; 9—in-plane lever; 10—the first deep groove ball bearing; 11—the second deep groove ball bearing 12—the first joint bearing; 13—the second joint bearing; 14—the third ear plate; 15—out-of-plane damper; 16—out-of-plane link rod; 17—out-of-plane lever; 18—the third deep groove ball bearing; 19—the fourth deep groove ball bearing; 20—the fifth deep groove ball bearing; 21—the third joint bearing; 22—the fourth joint bearing; 23—cable clamp; 24—connecting rod; 25—the fifth joint bearing; 26—outer frame; 27—embedded plate.

DETAILED DESCRIPTION OF THE EMBODIMENTS

In order to make the purpose, technical solutions and advantages of the embodiments of the present invention clearer, the technical solutions in the embodiments of the present invention will be described clearly and completely below in conjunction with the drawings in the embodiments of the present invention. Obviously, the described embodiments are only part of the embodiments of the present invention, rather than all the embodiments. Based on the embodiments in the present invention, all other embodiments obtained by a person of ordinary skill in the art without inventive efforts shall fall within the protection scope of the present invention.

Figure 1:
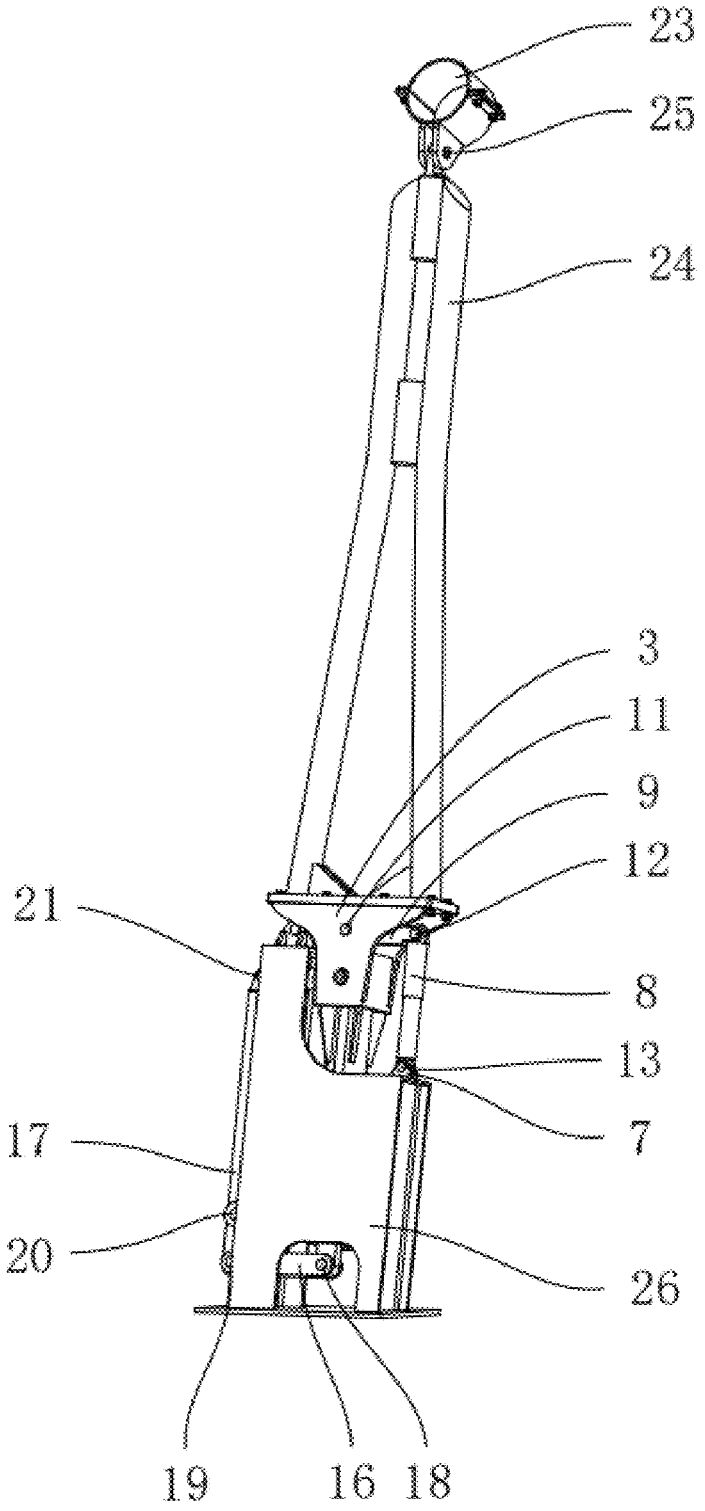
FIG. 1 is an overall structural diagram of a stay cable lever mass damper of the present invention.
Figure 2:
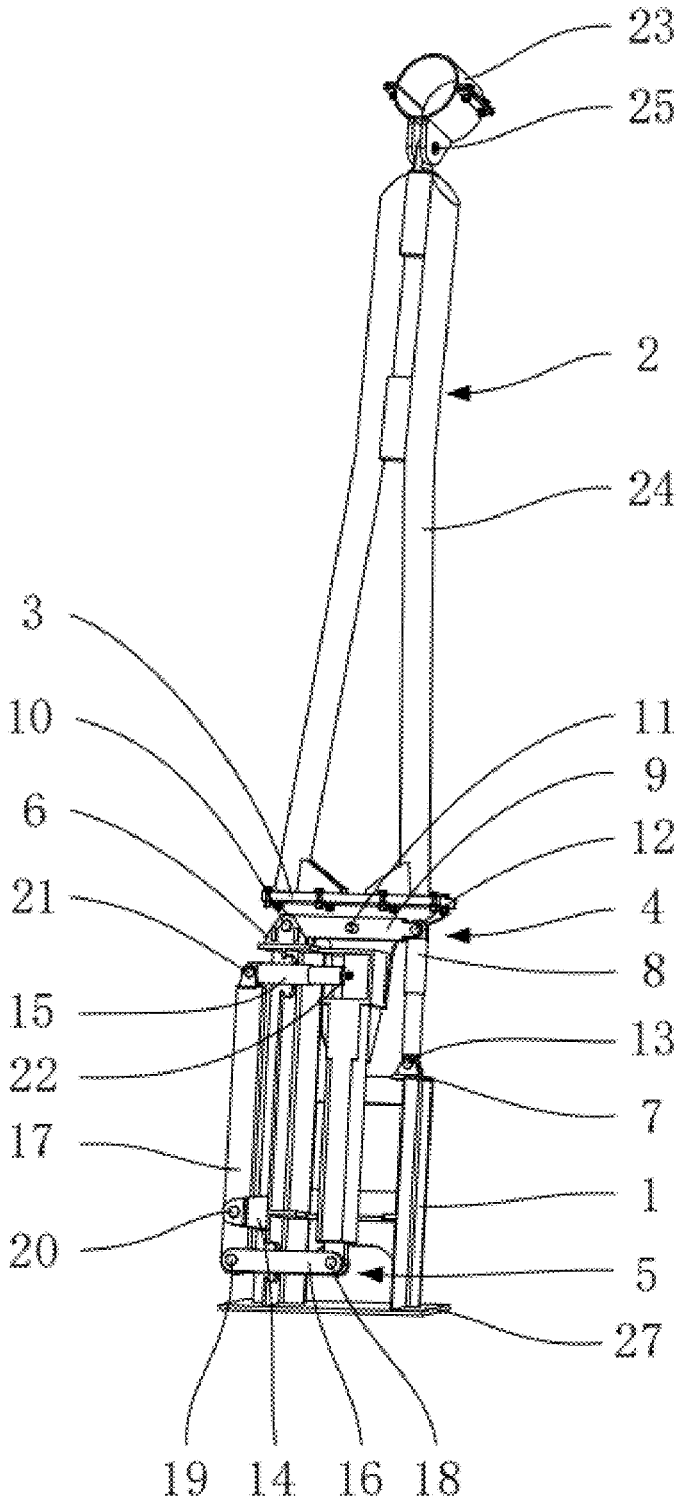
FIG. 2 is a structural diagram of a stay cable lever mass damper without an outer frame of the present invention.

As shown in FIG. 1 and FIG. 2, the embodiment of the present invention provides a stay cable lever mass damper, comprising a support 1, a connecting piece 2, a main lever 3, a first damping device 4 (in-plane damping device) and a second damping device 5 (out-of-plane damping device), wherein the connecting piece 2 is configured to connect with the stay cable; one end of the main lever 3 is fixedly connected to the connecting piece 2, and the other end is rotatably connected to the support 1; the first damping device 4 is connected to an upper end of the main lever 3 and configured to mitigate in-plane vibration on the main lever 3; and the second damping device 5 is connected to a lower end of the main lever 3 and configured to mitigate out-of-plane vibration on the main lever 3.

In this embodiment, the stay cable lever mass damper comprises a support 1, a connecting piece 2, a main lever 3, a first damping device 4 and a second damping device 5, wherein the connecting piece 2 is configured to connect with the stay cable; one end of the main lever 3 is fixedly connected to the connecting piece 2, and the other end is rotatably connected to the support 1; the first damping device 4 is connected to an upper end of the main lever 3 and configured to mitigate in-plane vibration on the main lever 3; and the second damping device 5 is connected to a lower end of the main lever 3 and configured to mitigate out-of-plane vibration on the main lever 3.

When the stay cable has in-plane vibration, the in-plane vibration will be transmitted to the connecting piece 2 since the stay cable is connected to the connecting piece 2. Since one end of the main lever 3 is fixedly connected to the connecting piece 2, the in-plane vibration will be transmitted to the main lever 3 through the connecting piece 2. Since the first damping device 4 is connected to the upper end of the main lever 3, when there is in-plane vibration on the main lever 3, the first damping device 4 will mitigate the in-plane vibration.

In addition, when the stay cable has out-of-plane vibration, the out-of-plane vibration will be transmitted to the connecting piece 2 since the stay cable is connected to the connecting piece 2. Since one end of the main lever 3 is fixedly connected to the connecting piece 2, the out-of-plane vibration will be transmitted to the main lever 3 through the connecting piece 2. Since the second damping device 5 is connected to the lower end of the main lever 3, when there is out-of-plane vibration on the main lever 3, the second damping device 5 will mitigate the out-of-plane vibration.

At the same time, the vibration of the stay cable is transferred to the connecting piece 2 through connecting the stay cable to the connecting piece 2, the vibration is transmitted to the main lever 3 through connecting the main lever 3 to the connecting piece 2, and the first damping device 4 is connected to the upper end of the main lever 3 and configured to mitigate the in-plane vibration on the main lever 3; and the second damping device 5 is connected to the lower end of the main lever 3 and configured to mitigate the out-of-plane vibration on the main lever 3. The present application can mitigate both in-plane vibration and out-of-plane vibration.

In some embodiments, the support 1 is provided with a first ear plate 6 and a second ear plate 7;

the first damping device 4 comprises an in-plane damper 8 and an in-plane lever 9, and the in-plane damper 8 is rotatably connected to the second ear plate 7; and the middle part of the in-plane lever 9 is rotatably connected to the main lever 3, one end of the in-plane lever 9 is rotatably connected to the first ear plate 6, and the other end is connected to the in-plane damper 8.

In this embodiment, the stay cable lever mass damper comprises a support 1, a connecting piece 2, a main lever 3, a first damping device 4 and a second damping device 5, wherein the connecting piece 2 is configured to connect with the stay cable; one end of the main lever 3 is fixedly connected to the connecting piece 2, and the other end is rotatably connected to the support 1; the first damping device 4 is connected to an upper end of the main lever 3 and configured to mitigate in-plane vibration on the main lever 3; and the second damping device 5 is connected to a lower end of the main lever 3 and configured to mitigate out-of-plane vibration on the main lever 3.

The support 1 is provided with a first ear plate 6 and a second ear plate 7;

the first damping device 4 comprises an in-plane damper 8 and an in-plane lever 9, and the in-plane damper 8 is rotatably connected to the second ear plate 7; and the middle part of the in-plane lever 9 is rotatably connected to the main lever 3, one end of the in-plane lever 9 is rotatably connected to the first ear plate 6, and the other end is connected to the in-plane damper 8.

In addition, the in-plane damper 8 is rotatably connected to the second ear plate 7; the middle part of the in-plane lever 9 is rotatably connected to the main lever 3, one end of the in-plane lever 9 is rotatably connected to the first ear plate 6, and the other end is connected to the in-plane damper 8. When the in-plane vibration occurs, the in-plane lever 9 rotates around the main lever 3 and the first ear plate 6, and then the in-plane damper 8 rotates around the second ear plate 7, and the in-plane damper 8 mitigates the in-plane vibration.

At the same time, the in-plane damper 8 adopts a viscous damper, which is made based on the principle of fluid movement, especially the throttling resistance generated when the fluid passes through the throttling hole. The in-plane damper 8 has the advantages of high energy dissipation efficiency, not increasing structural stiffness, and not altering the natural vibration period of the structure, while maintaining stable performance of the viscous damper. Moreover, regular inspections will be performed based on the designed service life and design requirements. Under normal usage conditions, it has the advantage of being durable and not easily damaged.

In some embodiments, the stay cable lever mass damper further comprises: a first deep groove ball bearing 10 and a second deep groove ball bearing 11, wherein the in-plane lever 9 is rotatably connected to the first ear plate 6 through the first deep groove ball bearing 10; and the middle part of the in-plane lever 9 is rotatably connected to the main lever 3 through the second deep groove ball bearing 11.

In this embodiment, the stay cable lever mass damper comprises a support 1, a connecting piece 2, a main lever 3, a first damping device 4 and a second damping device 5, wherein the connecting piece 2 is configured to connect with the stay cable; one end of the main lever 3 is fixedly connected to the connecting piece 2, and the other end is rotatably connected to the support 1; the first damping device 4 is connected to an upper end of the main lever 3 and configured to mitigate in-plane vibration on the main lever 3; and the second damping device 5 is connected to a lower end of the main lever 3 and configured to mitigate out-of-plane vibration on the main lever 3.

The support 1 is provided with a first ear plate 6 and a second ear plate 7;

the first damping device 4 comprises an in-plane damper 8 and an in-plane lever 9, and the in-plane damper 8 is rotatably connected to the second ear plate 7; the middle part of the in-plane lever 9 is rotatably connected to the main lever 3, one end of the in-plane lever 9 is rotatably connected to the first ear plate 6, and the other end is connected to the in-plane damper 8;

the stay cable lever mass damper further comprises: a first deep groove ball bearing 10 and a second deep groove ball bearing 11, wherein the in-plane lever 9 is rotatably connected to the first ear plate 6 through the first deep groove ball bearing 10; and the middle part of the in-plane lever 9 is rotatably connected to the main lever 3 through the second deep groove ball bearing 11.

At the same time, since the in-plane lever 9 is rotatably connected to the first ear plate 6 through the first deep groove ball bearing 10, the middle part of the in-plane lever 9 is rotatably connected to the main lever 3 through the second deep groove ball bearing 11. The deep groove ball bearing mainly bears radial loads, but can also withstand radial loads and axial loads at the same time. The contact angle is zero when only radial loads are borne. When the deep groove ball bearing has a large radial clearance, it has the performance of an angular contact bearing and can withstand a large axial load, and the friction coefficient of the deep groove ball bearing is very small. Therefore, the rotation of the in-plane lever 9, the first ear plate 6, and the main lever 3 can be effectively transmitted through the first deep groove ball bearing 10 and the second deep groove ball bearing 11.

In some embodiments, the stay cable lever mass damper further comprises: a first joint bearing 12 and a second joint bearing 13, the in-plane lever 9 is rotatably connected to the in-plane damper 8 through the first joint bearing 12, and the in-plane damper 8 is rotatably connected to the second ear plate 7 through the second joint bearing 13.

In this embodiment, the joint bearing can withstand a larger load. The in-plane lever 9 is rotatably connected to the in-plane damper 8 through the first joint bearing 12, and the in-plane damper 8 is rotatably connected to the second ear plate 7 through the second joint bearing 13, which can effectively improve the service life.

In some embodiments, a third ear plate 14 is provided on the support 1;

the second damping device 5 comprises an out-of-plane damper 15, an out-of-plane link rod 16 and an out-of-plane lever 17, and the out-of-plane damper 15 is rotatably connected to the middle part of the main lever 3; one end of the out-of-plane link rod 16 is rotatably connected to the bottom part of the main lever 3; and one end of the an out-of-plane lever 17 is rotatably connected to the out-of-plane link rod 16, the other end of the out-of-plane lever 17 is rotatably connected to the out-of-plane damper 15, and the middle part of the out-of-plane lever 17 is rotatably connected to the third ear plate 14.

In this embodiment, since the out-of-plane damper 15 is rotatably connected to the middle part of the main lever 3, one end of the out-of-plane link rod 16 is rotatably connected to the bottom part of the main lever 3; and one end of the out-of-plane lever 17 is rotatably connected to the out-of-plane link rod 16, the other end of the out-of-plane lever 17 is rotatably connected to the out-of-plane damper 15, and the middle part of the out-of-plane lever 17 is rotatably connected to the third ear plate 14. When out-of-plane vibration occurs, the out-of-plane vibration of the main lever 3 drives the out-of-plane link rod 16 to swing, the out-of-plane link rod 16 transfers the out-of-plane vibration to the out-of-plane lever 17, the out-of-plane lever 17 transfers the energy of the out-of-plane vibration to the out-of-plane damper 15, and the out-of-plane damper 15 mitigates the energy of the out-of-plane vibration.

The out-of-plane damper 15 adopts a viscous damper.

In some embodiments, the stay cable lever mass damper further comprises: a third deep groove ball bearing 18, a fourth deep groove ball bearing 19 and a fifth deep groove ball bearing 20, wherein the out-of-plane link rod 16 is rotatably connected to the main lever 3 through the third deep groove ball bearing 18; the out-of-plane link rod 16 is rotatably connected to the out-of-plane lever 17 through the fourth deep groove ball bearing 19; and the out-of-plane lever 17 is rotatably connected to the third ear plate 14 through the fifth deep groove ball bearing 20.

In this embodiment, the deep groove ball bearing has the performance of an angular contact bearing when the deep groove ball bearing has a large radial clearance, can withstand a large axial load, and the deep groove ball bearing has a very small friction coefficient. The rotation of the out-of-plane link rod 16, the out-of-plane lever 17 and the third ear plate 14 is effectively transmitted through the third deep groove ball bearing 18, the fourth deep groove ball bearing 19 and the fifth deep groove ball bearing 20.

In some embodiments, the stay cable lever mass damper further comprises: a third joint bearing 21 and a fourth joint bearing 22, wherein the out-of-plane lever 17 is rotatably connected to the out-of-plane damper 15 through the third joint bearing 21; and the out-of-plane damper 15 is rotatably connected to the main lever 3 through the fourth joint bearing 22.

In this embodiment, the performance of the joint bearing to withstand larger loads enables the effective transmission of the rotation of the main lever 3, out-of-plane damper 15, and out-of-plane lever 17 through the third joint bearing 21 and the fourth joint bearing 22.

In some embodiments, the connecting piece 2 comprises a cable clamp 23, a connecting rod 24 and a fifth joint bearing 25, and the cable clamp 23 is configured to connect with the stay cable; the connecting rod 24 is rotatably connected to the main lever 3; and the cable clamp 23 is rotatably connected to the connecting rod 24 through the fifth joint bearing 25.

In some embodiments, an outer frame 26 is sleeved on the support 1.

In some embodiments, an embedded plate 27 is connected to the bottom part of the support 1.

In this embodiment, the embedded plate 27 is arranged in the bridge deck to better fix the support 1 on the bridge.

The operation mode of the present invention is as follows:

The running mode of the present invention is as follows:

When the stay cable occurs in-plane vibration under external forces:

S10. The stay cable performs in-plane vibration.

S11. The cable clamp 23 vibrates, driving the connecting rod 24 to vibrate, which in turn drives the main lever 3 to perform in-plane vibration.

S12. The in-plane vibration of the main lever 3 is transmitted to the in-plane lever 9 through the second deep groove ball bearing 11.

S13. The in-plane lever 9, with the first deep groove ball bearing 10 as its rotational pivot, transmits the vibration of the in-plane lever 9 to the in-plane damper 8.

S14. The in-plane damper 8 mitigates the energy of the in-plane vibration.

When the stay cable performs out-of-plane vibration under external influence:

S20. The stay cable performs out-of-plane vibration.

S21. The cable clamp 23 vibrates, driving the connecting rod 24 to vibrate, which in turn drives the main lever 3 to perform out-of-plane vibration.

S22. The out-of-plane vibration of the main lever 3 drives the out-of-plane link rod 16 to swing through the second deep groove ball bearing 11 and the third deep groove ball bearing 18.

S23. The out-of-plane link rod 16 transmits the out-of-plane vibration to the out-of-plane lever 17 through the fourth deep groove ball bearing 19.

S24. The out-of-plane lever 17, with the fifth deep groove ball bearing 20 as its rotational pivot, transmits the energy of the out-of-plane vibration to the out-of-plane damper 15.

S25. The out-of-plane damper 15 mitigates the energy of the out-of-plane vibration.

The present invention has the following advantages:

The vibration of the stay cable is transferred to the connecting piece through connecting the stay cable to the connecting piece, the vibration is transmitted to the main lever through connecting the main lever to the connecting piece, and the first damping device is connected to the upper end of the main lever and configured to mitigate the in-plane vibration on the main lever; and the second damping device is connected to the lower end of the main lever and configured to mitigate the out-of-plane vibration on the main lever.

In the description of the present invention, it should be noted that the orientation or positional relationship indicated by the terms "upper", "lower", etc. are based on the orientation or positional relationship shown in the drawings, which is only for the convenience of describing the present invention and simplifying the description, instead of indicating or implying that the pointed device or element must have a specific orientation, be configured and operated in a specific orientation, therefore it may not be understood as a limitation of the present invention. Unless otherwise clearly specified and limited, the terms "installation", "connected" and "connection" should be understood in a broad sense. For example, it can be a fixed connection, a detachable connection, or an integral connection; further can be a mechanical connection, or an electrical connection; further can be directly connected, or indirectly connected through an intermediate medium, or can be the internal communication between two components. For those of ordinary skill in the art, the specific meanings of the above-mentioned terms in the present application may be understood according to specific circumstances.

It should be noted that relational terms such as "first" and "second" are only for distinguishing one entity or operation from another entity or operation in the present invention, and do not necessarily require or imply any such actual relationship or order between these entities or operations. Moreover, the terms "include", "comprise" or any other variants thereof are intended to cover non-exclusive inclusion, so that a process, method, article or device comprising a series of elements not only comprises those elements, but also comprises those that are not explicitly listed, or further comprises elements inherent to the process, method, article, or device.

The above-mentioned are only the embodiments of the present invention, so that those skilled in the art may understand or implement the present invention. For those skilled in the art, various modifications to these embodiments will be obvious, and the general principles defined herein may be implemented in other embodiments without departing from the spirit or scope of the present invention. Therefore, the present invention will not be limited to the embodiments shown in this document, but will be subject to the widest scope consistent with the principles and novel features applied herein.

What is claimed is:

1. A stay cable lever mass damper, comprising:

a support;

a connecting piece;

a main lever, wherein a first end of the main lever is fixedly connected to the connecting piece;

a first damping device, wherein the first damping device is connected to an upper end of the main lever and configured to mitigate in-plane vibration on the main lever; and a second damping device, wherein the second damping device is connected to a lower end of the main lever and configured to mitigate out-of-plane vibration on the main lever;

wherein a first ear plate and a second ear plate are provided on the support;

the first damping device comprises:

an in-plane damper, wherein the in-plane damper is rotatably connected to the second ear plate; and an in-plane lever, wherein a middle part of the in-plane lever is rotatably connected to the main lever, a first end of the in-plane lever is rotatably connected to the first ear plate, and a second end of the in-plane lever is connected to the in-plane damper.

2. The stay cable lever mass damper according to claim 1, wherein the stay cable lever mass damper further comprises: a first deep groove ball bearing and a second deep groove ball bearing, wherein the in-plane lever is rotatably connected to the first ear plate through the first deep groove ball bearing; and the middle part of the in-plane lever is rotatably connected to the main lever through the second deep groove ball bearing.

3. The stay cable lever mass damper according to claim 1, wherein the stay cable lever mass damper further comprises: a first joint bearing and a second joint bearing, the in-plane lever is rotatably connected to the in-plane damper through the first joint bearing, and the in-plane damper is rotatably connected to the second ear plate through the second joint bearing.

4. A stay cable lever mass damper, comprising:

a support;

a connecting piece;

a main lever, wherein a first end of the main lever is fixedly connected to the connecting piece;

a first damping device, wherein the first damping device is connected to an upper end of the main lever and configured to mitigate in-plane vibration on the main lever; and a second damping device, wherein the second damping device is connected to a lower end of the main lever and configured to mitigate out-of-plane vibration on the main lever;

wherein a third ear plate is provided on the support;

the second damping device comprises:

an out-of-plane damper, wherein the out-of-plane damper is rotatably connected to a middle part of the main lever;

an out-of-plane link rod, wherein one end of the out-of-plane link rod is rotatably connected to a bottom part of the main lever; and an out-of-plane lever, wherein a first end of the out-of-plane lever is rotatably connected to the out-of-plane link rod, a second end of the out-of-plane lever is rotatably connected to the out-of-plane damper, and a middle part of the out-of-plane lever is rotatably connected to the third ear plate.

5. The stay cable lever mass damper according to claim 4, wherein the stay cable lever mass damper further comprises: a third deep groove ball bearing, a fourth deep groove ball bearing and a fifth deep groove ball bearing, wherein the out-of-plane link rod is rotatably connected to the main lever through the third deep groove ball bearing; the out-of-plane link rod is rotatably connected to the out-of-plane lever through the fourth deep groove ball bearing; and the out-of-plane lever is rotatably connected to the third ear plate through the fifth deep groove ball bearing.

6. The stay cable lever mass damper according to claim 4, wherein the stay cable lever mass damper further comprises: a third joint bearing and a fourth joint bearing, wherein the out-of-plane lever is rotatably connected to the out-of-plane damper through the third joint bearing; and the out-of-plane damper is rotatably connected to the main lever through the fourth joint bearing.

7. The stay cable lever mass damper according to claim 1, wherein the connecting piece comprises:

a cable clamp;

a connecting rod, wherein the connecting rod is rotatably connected to the main lever; and a fifth joint bearing, wherein the cable clamp is rotatably connected to the connecting rod through the fifth joint bearing.

8. The stay cable lever mass damper according to claim 1, wherein an outer frame is sleeved on the support.

9. The stay cable lever mass damper according to claim 1, wherein an embedded plate is connected to a bottom part of the support.

* * * * *